US009556000B2

(12) United States Patent
Carman

(10) Patent No.: US 9,556,000 B2
(45) Date of Patent: Jan. 31, 2017

(54) REEL ASSEMBLY

(71) Applicant: INTEPLAST GROUP, LTD., Livingston, NJ (US)

(72) Inventor: Gregory A. Carman, Victoria, TX (US)

(73) Assignee: Inteplast Group Corporation, Livingston, NJ (US)

( * ) Notice: Subject to any disclaimer, the term of this patent is extended or adjusted under 35 U.S.C. 154(b) by 381 days.

(21) Appl. No.: 14/264,858

(22) Filed: Apr. 29, 2014

(65) Prior Publication Data

US 2015/0307316 A1 Oct. 29, 2015

(51) Int. Cl.
*B65H 75/22* (2006.01)
*B65H 75/14* (2006.01)

(52) U.S. Cl.
CPC ..... *B65H 75/22* (2013.01); *B65H 75/14* (2013.01); *B65H 2701/5112* (2013.01)

(58) Field of Classification Search
CPC ..... B65H 75/22; B65H 75/14; B65H 75/18
USPC ..... 242/610.1–610.2, 610.6, 118.8
See application file for complete search history.

(56) References Cited

U.S. PATENT DOCUMENTS

| | | | |
|---|---|---|---|
| 697,668 | A | 4/1902 | Schleicher |
| 2,799,458 | A | 7/1957 | Nye |
| 3,058,775 | A | 10/1962 | Schliephacke |
| 3,869,079 | A | 3/1975 | Oglesbee |
| 3,876,073 | A | 4/1975 | Herbetko |
| 4,830,270 | A | 5/1989 | Holmes |
| 5,509,620 | A | 4/1996 | Crews |
| 5,735,483 | A | 4/1998 | Bierlein |
| 5,791,590 | A | 8/1998 | Zuk et al. |
| 6,575,398 | B2 | 6/2003 | Nakamura et al. |
| 2007/0170234 | A1 | 7/2007 | Cargile, Jr |

FOREIGN PATENT DOCUMENTS

| | | | | |
|---|---|---|---|---|
| AT | DE 3703018 A1 * | 8/1987 | ..... | B65H 75/14 |
| CA | 2047652 C * | 1/1995 | ..... | B65H 75/22 |
| DE | 29502721 U1 * | 8/1995 | ..... | B65H 75/22 |
| GB | 2165214 A * | 4/1986 | ..... | B65H 75/14 |
| IT | EP 2565140 A1 * | 3/2013 | ..... | B65H 75/14 |
| IT | EP 2634127 A1 * | 9/2013 | ..... | B65H 75/14 |

* cited by examiner

*Primary Examiner* — William E Dondero
(74) *Attorney, Agent, or Firm* — Senniger Powers LLP

(57) ABSTRACT

A set of blanks for being repeatedly assembled into a reel configuration. A flange blank has pass through slots angularly spaced apart from one another and interlocking apertures angularly aligned with the pass through slots. Each pass through slot is spaced radially from an interlocking aperture. A core blank has a hub portion that is folded toward a core configuration in which it has an annular shape. Push tabs extend outwardly from the hub portion. Each of the push tabs passes through a pass through slot. Each push tab includes a spine and a pair of wings extending outwardly from the spine. The wings of each push tab bend away from a coplanar position with respect to their spine as the push tab is inserted in an interlocking aperture. The wings lockingly engage the flange blank when each push tab is lockingly received in the interlocking aperture.

21 Claims, 14 Drawing Sheets

REEL ASSEMBLY

FIELD OF THE INVENTION

The present invention generally relates to a reel assembly. More particularly, the present invention relates to an interlocking structure for repeatedly securing a flange blank to a core blank in a reel configuration.

BACKGROUND OF THE INVENTION

Reels and reel assemblies are commonly used to store and transport elongate lines of flexible material (e.g., wires, cables, ropes, cords, etc.), but their three-dimensional structure is inconvenient when unused. Unused reels can be difficult to store, and treating reels as disposable goods (i.e., discarding them after each use) can be uneconomical. Conventional reel assemblies are often made of wood material, which is heavy, requires mechanical fasteners, and is not moisture resistant. It is desirable to have reels that can be reusably disassembled from their three-dimensional reel configurations for easy storage.

Certain conventional reel assemblies have been made from lighter weight materials such as papers, plastics, etc. These are initially assembled from multiple slabs of material (each, broadly, a "blank"). Adhesives are commonly used to secure blanks in respective positions of a reel configuration. Though adhesives may be sufficiently strong to secure some blanks in reel configurations, they do not permit easy disassembly without damaging the blanks.

For improved reusability, some reel assemblies have used sets of blanks having corresponding interlocking structural features that can be used to secure the blanks together in a reel configuration. However, these sets of blanks suffer from various limitations. For example, in some cases the interlocking structural features provide insufficient strength to set of blanks in the reel configuration under the strain of the static and dynamic forces of the items stored on the reel in use. Likewise, in some cases, the very use of the interlocking structural features causes damage thereto, rendering the set of blanks incapable of reuse after disassembly.

One example of an interlocking structural feature that suffers from these limitations is a dart-type lock. Dart-type locks typically include an opening and a corresponding dart tab configured to be lockingly received in the opening. The dart tab typically has a widthwise span that is slightly wider than the width of the opening. The widthwise span of a typical dart tab is oriented substantially orthogonal to the longitudinal axis of the dart panel. As the name suggests, the front edge of a dart tab is tapered to a point. A force is applied generally in the direction of the longitudinal axis of the dart tab to insert the dart tab into the opening. As the front edge (i.e., the point) of the dart tab is inserted further into the opening, the widthwise span is increasingly compressed by the constraints of the narrower opening. This makes dart-type tags difficult to use in reel assemblies. Though the dart tab may show some widthwise resilience once it is received in the opening (e.g., the widthwise span may return to a width wider than that of the opening), the act of insertion tends to damage the dart tab. Likewise, the act of pulling the dart tab out of the opening tends to inflict additional damage to the dart tab. The damage inflicted by inserting and removing the dart tab through the opening can permanently deform the dart tab such that its widthwise span becomes permanently narrower than the width of the opening. When this occurs, the dart-type lock becomes inoperable. As a result, dart-type locks are not well-suited for frequent reuse as an interlocking structure in a reel assembly.

Reusability is also hampered in reel assemblies designed to carry heavy loads. Heavy loads require stronger structural elements. For example, the core component of a reel must be designed with sufficient strength to carry heavy loads. Prior reel assemblies capable of carrying heavy loads are not known to disassemble into constituent planar parts.

Accordingly, a reel assembly with improved reusability is desired.

SUMMARY OF THE INVENTION

An aspect of the present invention includes a set of blanks for being repeatedly assembled into a reel configuration. A flange blank comprises an inwardly and an outwardly facing major surface, a plurality of pass through slots angularly spaced apart from one another about a transverse axis of the flange blank, and a plurality of interlocking apertures angularly aligned with the plurality of pass through slots. Each pass through slot is spaced apart radially from a corresponding one of the interlocking apertures. Each of the pass through slots has a pass through width, and each of the interlocking apertures has an interlocking width. The pass through width is wider than the interlocking width. A core blank comprises a hub portion having a longitudinal body comprising opposite lateral ends. The hub portion is configured to be folded toward a core configuration in which the hub portion has an annular shape. A plurality of push tabs are foldably attached to and extend outwardly from one of the opposite lateral ends of the hub portion. Each of the plurality of push tabs is configured to pass through a respective one of the pass through slots and be lockingly received in a respective one of the interlocking apertures when the hub portion is arranged in the core configuration. Each push tab comprises a spine and a pair of wings extending outwardly from the spine. The wings of each of the push tabs are configured to bend away from a coplanar position with respect to their respective spine as each push tab is being inserted in a respective one of the plurality of interlocking apertures. The wings of each of the push tabs are further configured to lockingly engage the inwardly facing major surface of the flange blank adjacent the respective one of the plurality of interlocking apertures when each push tab is lockingly received in the respective one of the plurality of interlocking apertures.

Another aspect of the present invention includes an interlocking structure for repeatedly securing a flange blank to a core blank in reel configuration. The flange blank has an inwardly facing major surface, a pass through slot, and an interlocking aperture. A lateral end of the core blank is configured to engage the inwardly facing major surface of the flange blank when the flange blank and the core blank are secured in the reel configuration. A push tab is foldably attached to and extends outwardly from the lateral end of the core blank and is configured to pass through the pass through slot and be lockingly received in the interlocking aperture. The push tab comprises a spine and a pair of wings extending outwardly from the spine. The wings of the push tab are configured to bend away from a coplanar position with respect to the spine as each push tab is being inserted in the interlocking aperture. The wings of the push tab are further configured to lockingly engage the inwardly facing major surface of the flange blank adjacent the interlocking aperture when each push tab is lockingly received therein.

Another aspect of the present invention includes a core blank for being repeatedly secured in a core configuration in a reel assembly. The core blank comprises a one-piece slab of fluted material. The slab comprises a pair of spaced apart sheets of plastic material held in spaced apart relationship by a plurality of spaced apart plastic ribs. The plurality of plastic ribs define a plurality of flutes. Each of the plurality of flutes has a longitudinal axis. The longitudinal axes of the plurality of flutes are oriented parallel to one another. A hub portion has a longitudinal body comprising opposite lateral ends. The hub portion comprises a plurality of core joints extending between the opposite lateral ends of the hub portion and defining fold lines in the hub portion transverse to the longitudinal axes of the plurality of flutes. Each of the plurality of core joints comprises a line along which the plastic sheets of the one-piece slab are sealed against one another. The hub portion is configured to be folded along the fold lines of the core joints toward a core configuration in which the longitudinal body has an annular shape.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
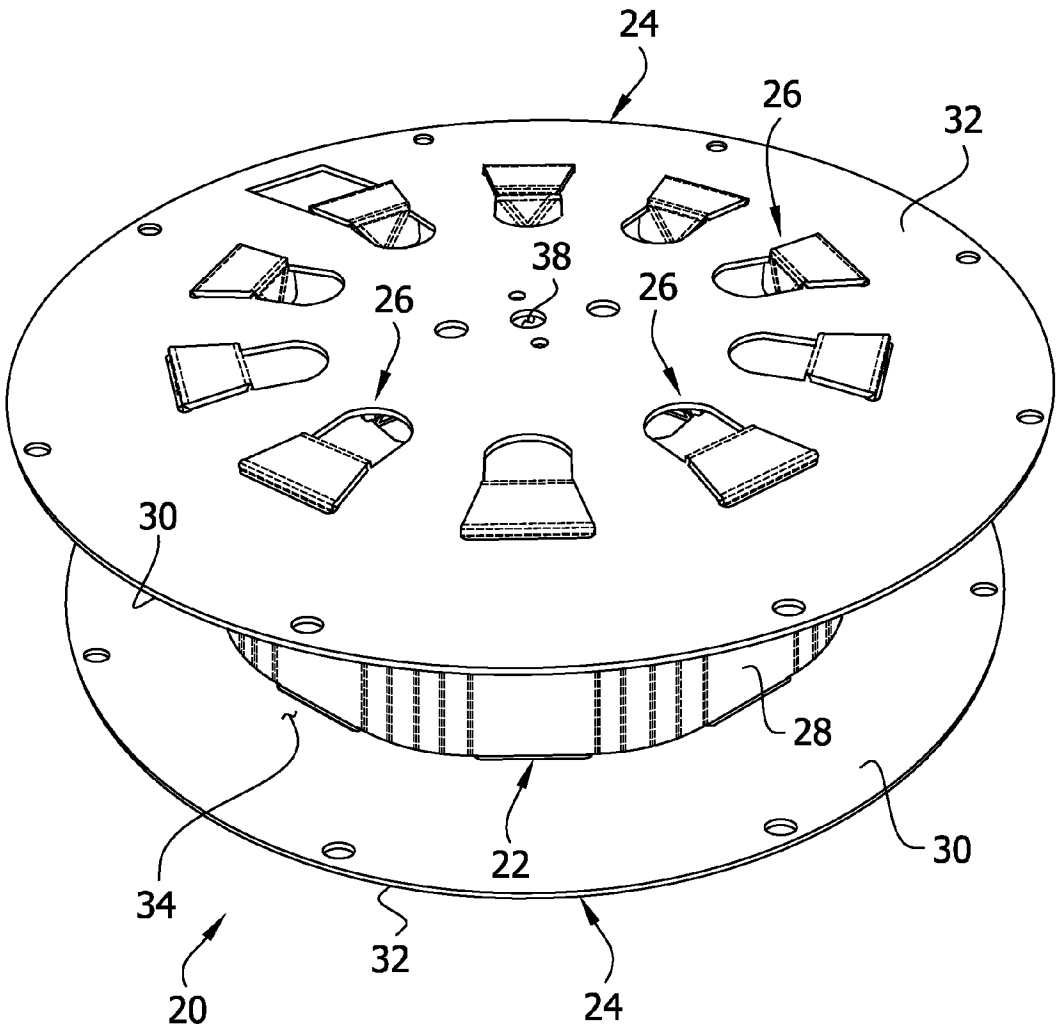
FIG. 1 is a perspective view of an embodiment of a reel assembly.

Referring to FIG. 1, an embodiment of a reel assembly of the present invention is generally designated by the reference number 20. The reel assembly 20 is made up of a set of blanks for being repeatedly assembled into a reel. The illustrated set of blanks includes a core blank 22 and a pair of substantially identical flange blanks 24. Though the illustrated embodiment includes two flange blanks 24 secured to opposite ends of the core blank 22, it is contemplated that other embodiments may use a single flange blank without departing from the scope of the invention. Still other components may also be used without departing from the scope of the invention. As will be discussed in greater detail below, each of the flange blanks 24 is secured to the core blank 22 using push tab-type interlocking structures 26. The illustrated reel assembly includes ten distinct interlocking structures 26. However, other embodiments may include more or fewer interlocking structures without departing from the scope of the invention.

In FIG. 1, the set of blanks that make up the reel assembly 20 is shown fully assembled in a reel configuration. In this configuration, the core blank 22 is folded into an annular shape. A major surface 28 of the core blank 22 faces outwardly of the reel assembly 20. Each of the flange blanks 24 has an inwardly facing major surface 30 and an outwardly facing major surface 32. The inwardly facing major surfaces 30 of each of the flange blanks 24 and the major surface 28 of the core blank 22 respectively define the shape of an annular storage channel 34. The reel assembly 20 is configured to receive an elongate line of flexible material (not shown) in the channel 34. For example, the elongate line of flexible material is, in an embodiment, wrapped against the major surface 28 of the core blank 22. The inwardly facing major surfaces 30 of the flange blanks 24 prevent the line of flexible material from shifting laterally on the major surface 28 of the core blank 22 past the flange blanks. Each of the illustrated flange blanks 24 includes a center axis hole 38. In certain embodiments, a rigid elongate member (not shown) is passed through each of the center axis holes 38 of the flange blanks 24. The reel assembly 20, in these embodiments, turns about the rigid elongate member for winding and unwinding the elongate line of flexible material onto and from the major surface 28 of the core blank 22. The reel may also include additional holes, slots, cutouts, doors, etc., of varying sizes, locations, and functions without departing from the scope of the invention. For example, another embodiment of a flange blank 124 with a slightly different arrangement of holes is illustrated in FIG. 2A. Features of the embodiment of FIG. 2A that correspond with features of the embodiment of FIG. 2 are given corresponding reference numbers, plus 100.

Figure 2:
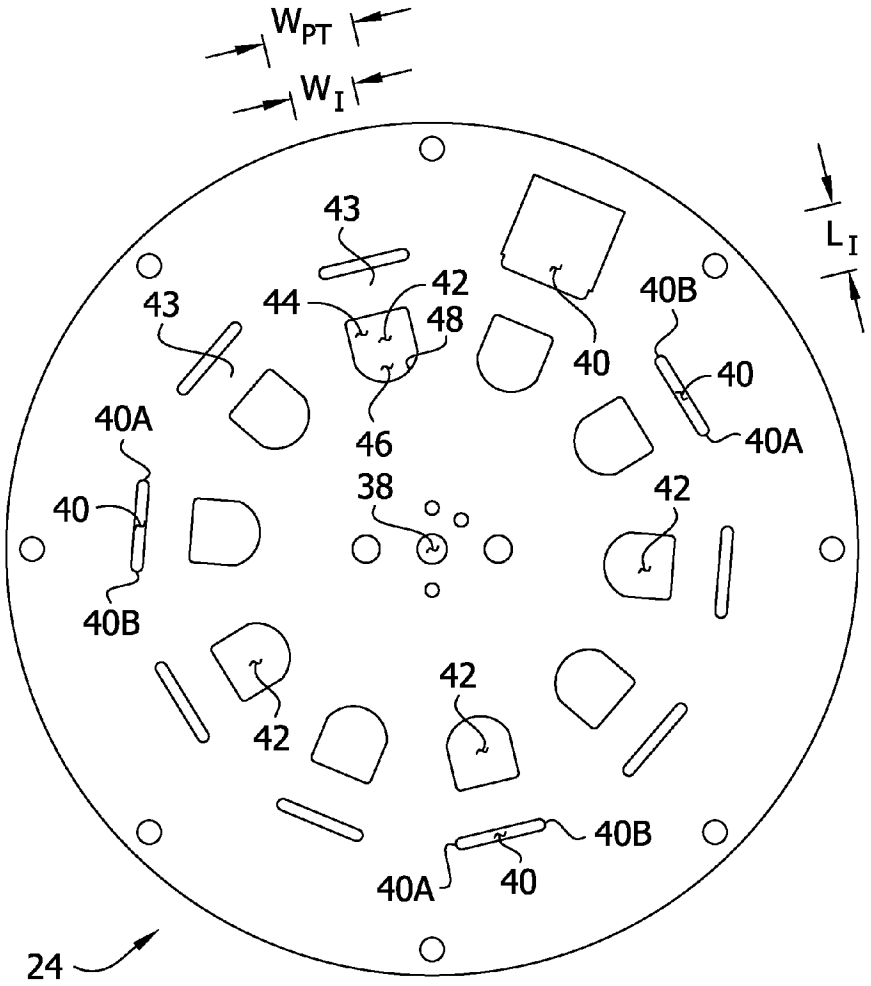
FIG. 2 is a top view of an embodiment of a flange blank.
Figure 2A:
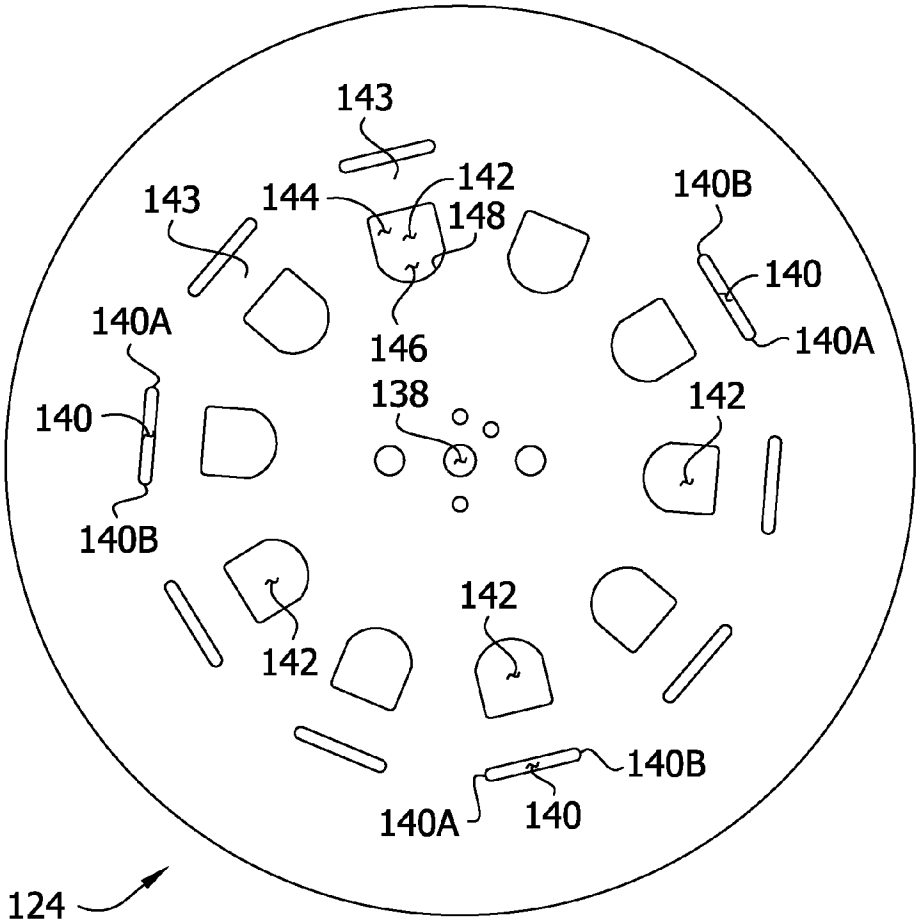
FIG. 2A is a top view of another embodiment of a flange blank.

Referring to FIG. 2, an exemplary flange blank 24 includes ten pass through slots 40. Other embodiments may include different numbers of pass through slots without departing from the scope of the invention. As will be discussed in greater detail below, each of the pass through slots 40 is, along with other interoperable features of the reel assembly 20, a constituent element of a respective interlocking structure 26. Each of the illustrated pass through slots 40 has an elongate shape with a length (which, in the illustrated embodiment, is the small dimension of the pass through slot) that is sized for receiving material that has the thickness of the core blank 22. The pass through slots 40 are angularly spaced apart from one another about a transverse axis of the flange blank. The transverse axis of the illustrated flange blank 24 is centered within the center axis hole 38 at the center of the circular flange blank. The pass through slots 40 are each spaced apart from the transverse axis the same radial distance, and neighboring ones of the pass through slots are spaced apart from one another the same angular dimension.

The flange blank 24 further includes ten interlocking apertures 42. Each of the interlocking apertures 42 is angularly aligned with a respective one of the pass through slots 40. Each pass through slot 40 is spaced apart radially outwardly from a corresponding one of the interlocking apertures 42. It is contemplated that, in other embodiments, pass through slots may be spaced apart radially inwardly from corresponding interlocking apertures without departing from the scope of the invention. In the illustrated embodiment, the interlocking apertures 42 are each spaced apart from the transverse axis the same radial distance (e.g., a radial distance less than the radial distance at which each of the pass through slots 40 are spaced from the transverse axis), and neighboring ones of the interlocking apertures are spaced apart from one another the same angular dimension (e.g., the same angular dimension at which neighboring ones of the pass through slots are spaced apart from one another). Between each interlocking aperture 42 and a respective one of the pass through slots 40 is a support portion 43 of the flange blank 24. Though the illustrated flange blank includes ten interlocking apertures 42, it should be understood that other flange blanks may include more or fewer interlocking apertures without departing from the scope of the invention. Like the pass through slots 40, the interlocking apertures 42 are each, along with other interoperable features of the reel assembly 20, constituent elements of respective interlocking structures 26.

The illustrated pass through slots 40 each have the same pass through width $W_{PT}$. In other embodiments, pass through slots may have varying pass through widths without departing from the scope of the invention. The illustrated interlocking apertures each have the same interlocking width $W_I$. It is further contemplated that, in some embodiments, interlocking apertures may have varying interlocking widths without departing from the scope of the invention. For corresponding pairs of pass through slots 40 and interlocking apertures 42, the pass through width $W_{PT}$ is greater than the interlocking width $W_I$. Each of the illustrated pass through slots 40 has a substantially constant length along its pass through width $W_{PT}$. The widthwise ends 40A, 40B of the pass through slots are rounded to improve the strength and durability of the pass through slots 40. Each of the interlocking apertures 42 has an interlocking length $L_I$. A radially outward portion 44 of each interlocking aperture 42 has a substantially constant width $W_I$. However, a radially inward portion 46 of each interlocking aperture 42 (that is radially inward of the flange blank 24) has a rounded end 48. In the illustrated embodiment, the rounded end 48 of each of the interlocking apertures 42 is rounded across its entire width. Thus, the interlocking apertures 42 each have a radially inward rounded end 48 with an arcuate shape (various embodiments may have radially inward rounded ends that are, e.g., semicircular, parabolic, etc.). As will be discussed in greater detail below, the shape of the rounded ends 48 of the interlocking aperture 42 improves the strength and durability of the flange blanks 24 and the interlocking structures 26.

Though FIG. 2 depicts only one flange blank 24, it should be understood that, in the illustrated embodiment of the reel assembly 20 (FIG. 1), the other flange blank has the same structure. It should further be understood that in other embodiments, two flange blanks may have different structures without departing from the scope of the invention.

Figure 3:
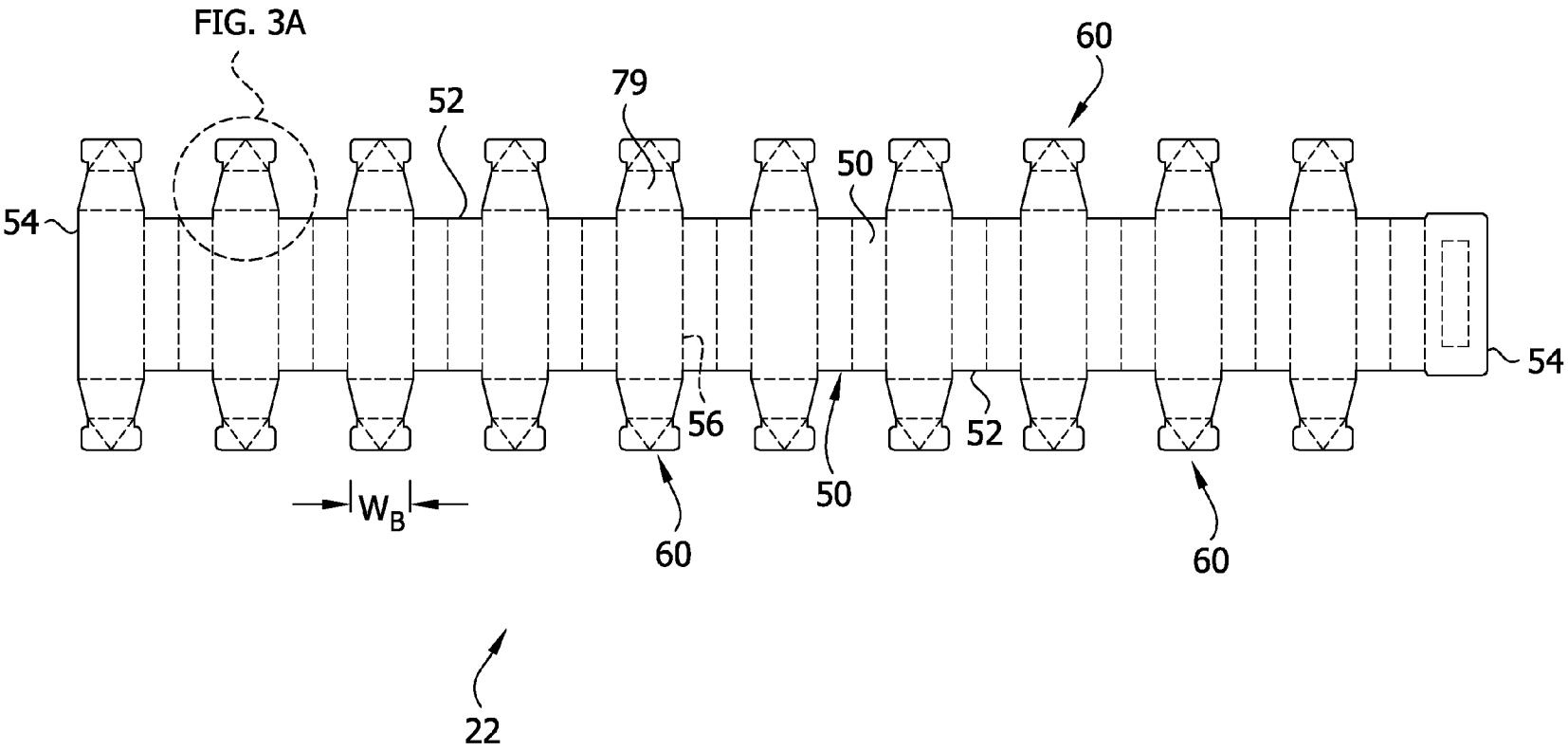
FIG. 3 is a top view of an embodiment of a core blank.

As shown best in FIG. 3, the core blank 22 comprises a hub portion 50. In the reel assembly 20 of FIG. 1, the major surface 28 of the core blank 22 is a major surface of the hub portion 50. The hub portion 50 has a longitudinal body comprising opposite lateral ends 52. The hub portion 50 is configured, in the illustrated embodiment, to be folded or curved toward a core configuration in which the hub portion has an annular shape. In suitable embodiments, longitudinal ends 54 of the hub portion 50 are configured to connect with one another in an interlocking manner to secure the hub portion in the core configuration (an annular shape) without using adhesives. The longitudinal ends 54 of the hub portion 50 may also be connected with any conventional means such as, for example, adhesives, mechanical fasteners, Velcro-type fasteners, self-connecting fasteners, etc. For example, the longitudinal ends 154 of the alternative embodiment of a core blank 122 of FIG. 3B have operatively opposed Velcro surfaces 155. Features of the embodiment of FIG. 3B that correspond to features of the embodiment of FIG. 3 are given corresponding reference numbers, plus 100. The core blank 222 of FIG. 3C includes a push tab type interlocking feature for securing the longitudinal ends 254 of the hub portion 250 to one another to secure the hub portion in an annular configuration. Features of the embodiment of FIG. 3C that correspond to features of the embodiment of FIG. 3 are given corresponding reference numbers, plus 200. The embodiments of core blanks 322 and 422 of FIGS. 3D and 3E each include dart-type interlocking features for securing the respective longitudinal ends 354, 454 of respective hub portions 350, 450 to one another to secure the respective hub portion in annular configurations. Features of the embodiment of FIG. 3D that correspond to features of the embodiment of FIG. 3 are given corresponding reference numbers, plus 300. Features of the embodiment of FIG. 3E that correspond to features of the embodiment of FIG. 3 are given corresponding reference numbers, plus 400.

As will be discussed in greater detail below, the core blank 22 FIG. 3 includes core joints 56 that define fold lines that aid in folding the hub portion 50 toward the core configuration. The core joints 56 are also configured to reduce the flexural resilience of the hub portion 50 such that the hub portion is less prone to resiliently return toward the planar configuration of FIG. 4 when bent toward the core configuration. The core joints 56 are oriented transverse to the longitudinal axis of the hub portion 50 and spaced apart from one another as discussed in greater detail below. In addition, the core joints 56 allow the hub portion 50 to easily be returned toward the planar configuration of FIG. 3 when not in use. It should be understood that, though the illustrated embodiment depicts a hub portion 50 having core joints 56, other embodiments may have no core joints without departing from the scope of the invention (see, e.g., the core blanks 122, 222, and 422 of FIGS. 3B, 3C, and 3E).

In addition to the hub portion 50, the core blank 22 comprises a plurality of push tabs, generally indicated at 60. As will be discussed in greater detail below, each of the push tabs 60 is, along with other interoperable features of the reel assembly 20, a constituent element of a respective interlocking structure 26. More specifically, each of the push tabs 60 is configured to be lockingly inserted in a respective one of the plurality of interlocking apertures 42 of a flange blank 24. Each of the plurality of push tabs 60 is attached to and extends outwardly from a respective one of the lateral ends 52 of the hub portion. In the illustrated embodiment, ten push tabs 60 extend laterally outward from each of the lateral ends 52 of the hub portion 50. The ten push tabs 60 on each lateral end of the hub portion 50 are spaced apart from one another along an axis parallel with the longitudinal axis of the hub portion. In the illustrated embodiment, the ten push tabs 60 along one lateral end 52 of the hub portion 50 are aligned with the ten push tabs on the other lateral end. As described in further detail below, each of the plurality of push tabs 60 is configured to pass through a respective one of the pass through slots 40 and be lockingly received in a respective one of the interlocking apertures 42 when the hub portion 50 is arranged in the core configuration. Due to the alignment on the push tabs 60 along respective lateral ends of the hub portion 50, when each of the push tabs is locked into a respective flange blank 24 (e.g., using respective pass through slots 40 and interlocking apertures 42), the pair of flange blanks 24 are angularly aligned with one another (e.g., their center axis holes 38 and each of their pass through slots and interlocking apertures are aligned with one another) when the reel assembly 20 is arranged in the reel configuration.

Figure 3A:
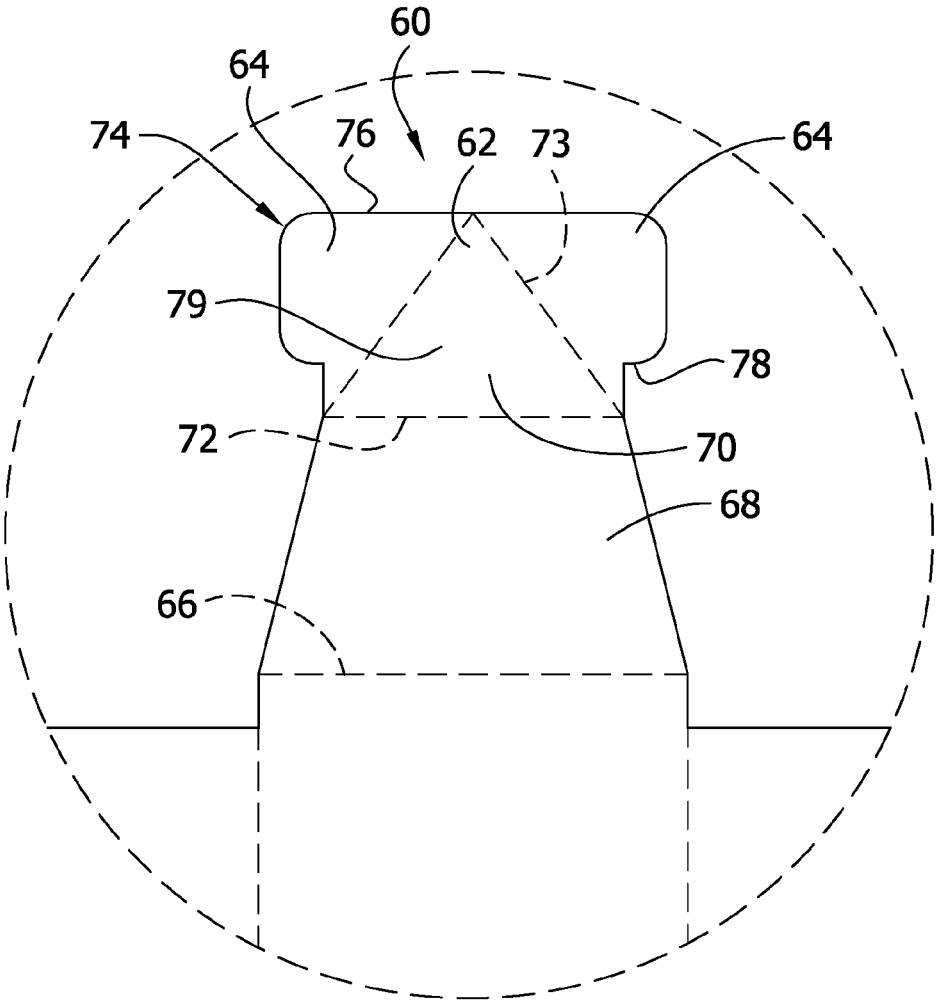
FIG. 3A is a magnified fragmentary top view of a portion of the core blank.
Figure 3B:
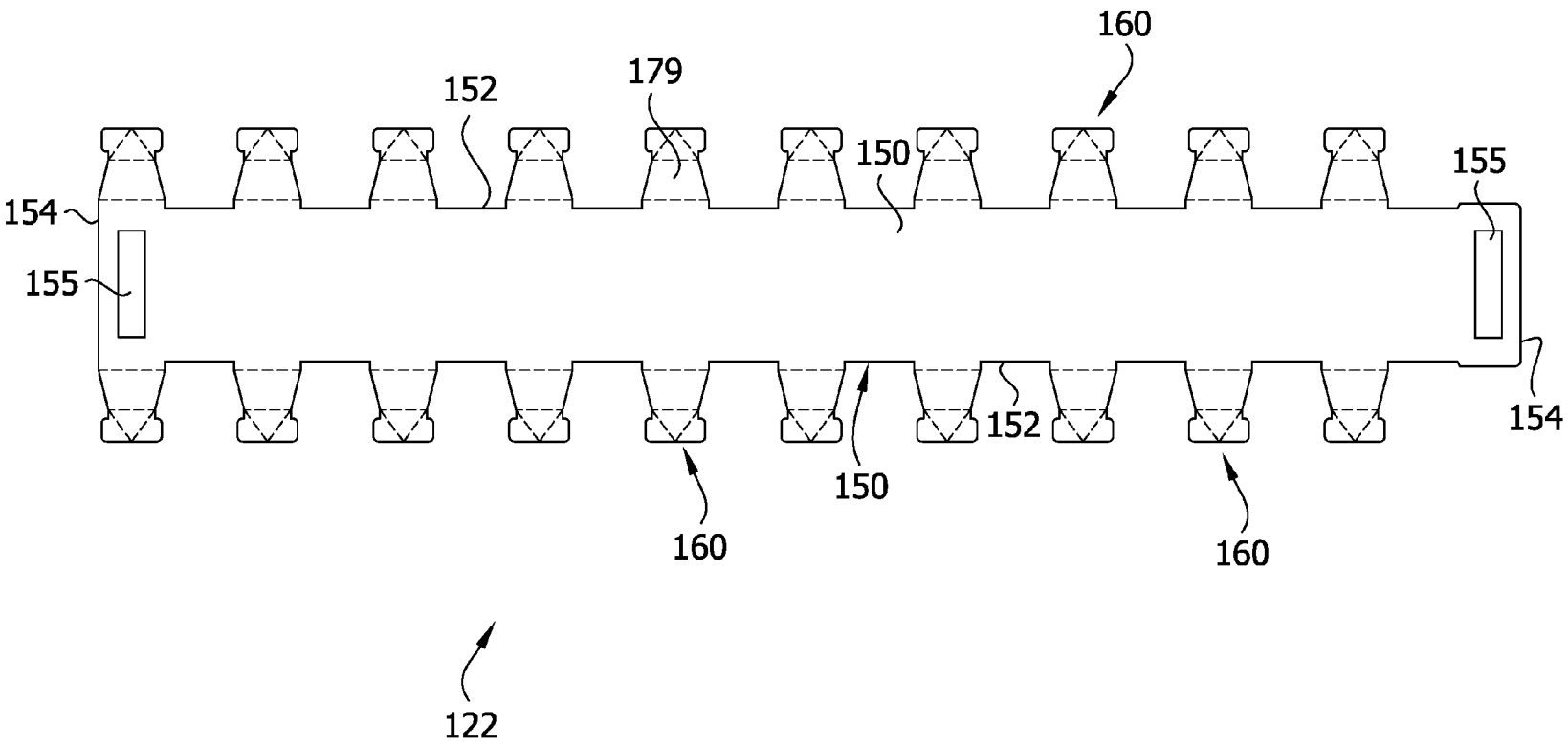
FIG. 3B is a top view of another embodiment of a core blank.
Figure 3C:
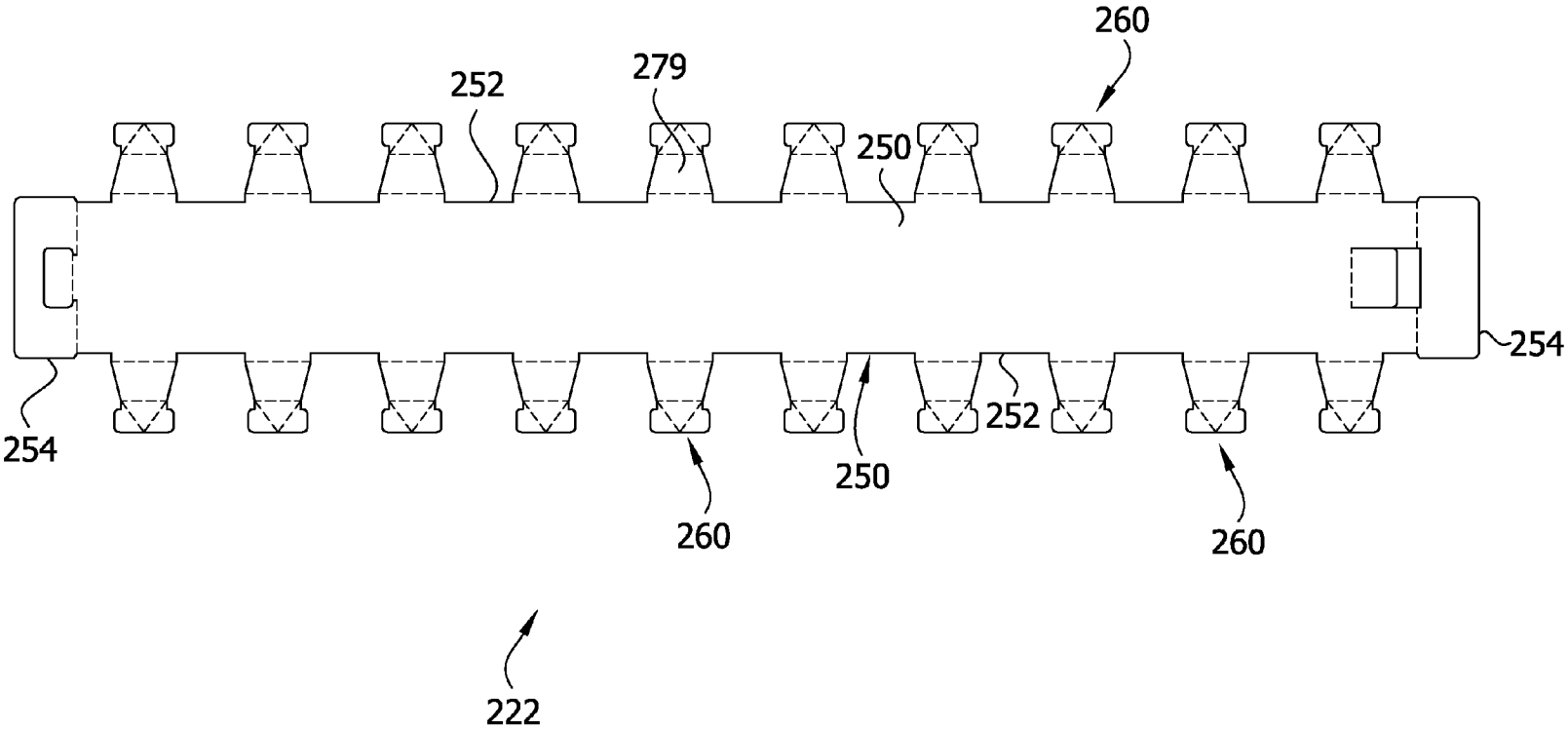
FIG. 3C is a top view of another embodiment of a core blank.
Figure 3D:
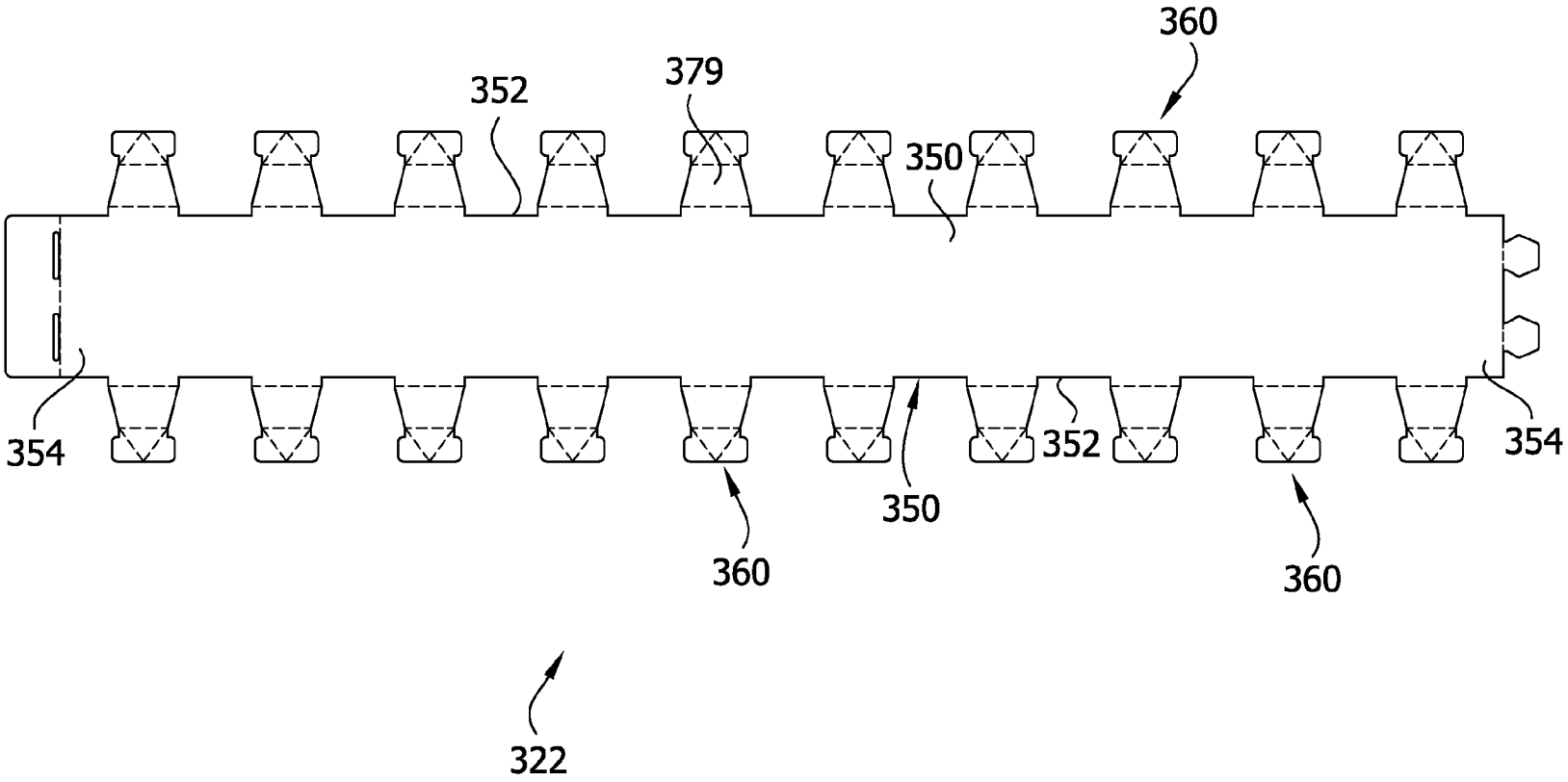
FIG. 3D is a top view of another embodiment of a core blank.
Figure 3E:
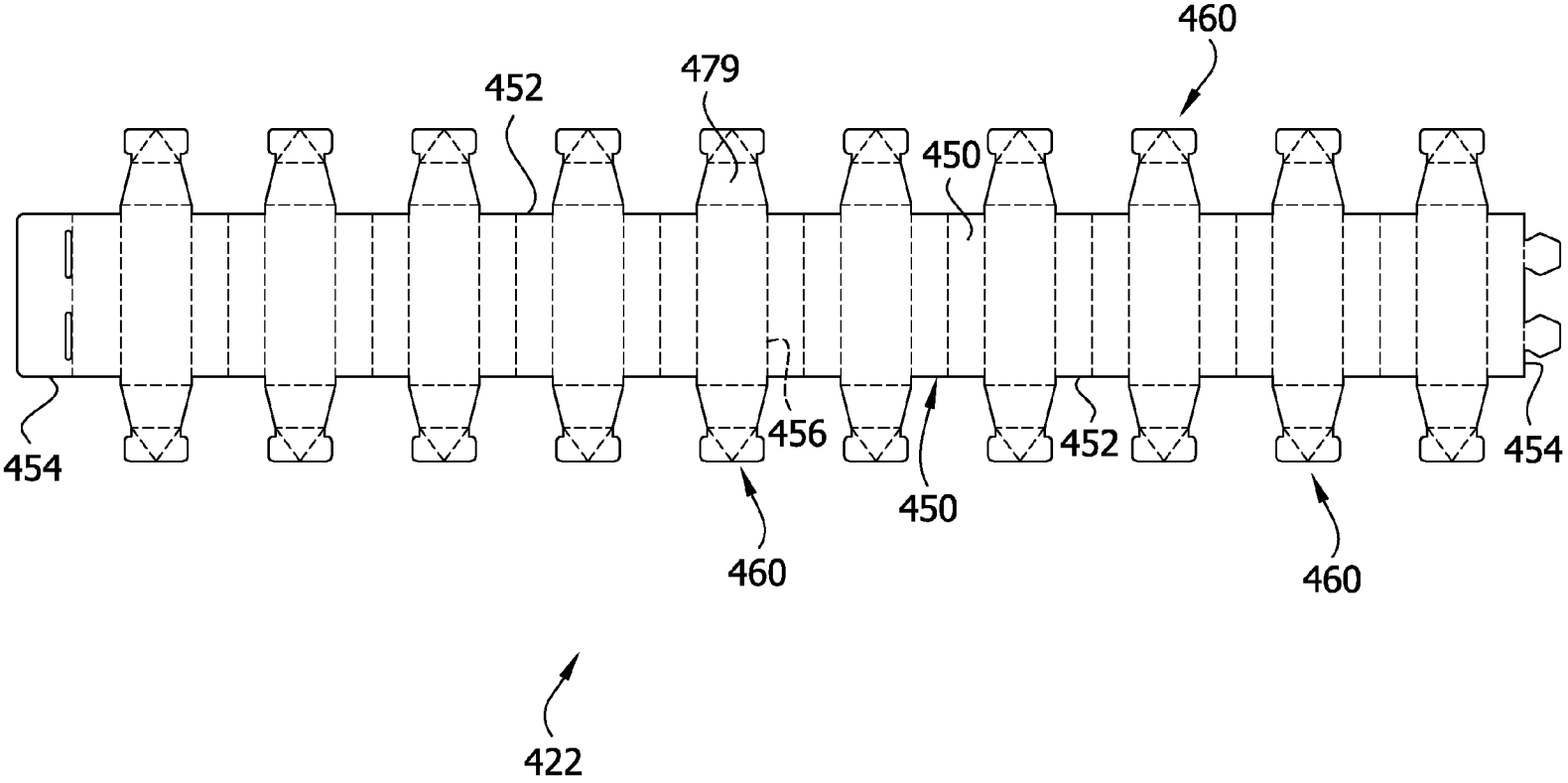
FIG. 3E is a top view of another embodiment of a core blank.

As shown best in FIG. 3A, each push tab 60 comprises a spine 62 and a pair of wings 64 extending outwardly from the spine. In the illustrated embodiment, each spine 62 extends laterally outward from a lateral end 52 of the hub portion 50. More specifically, each illustrated spine 62 is foldably connected to a respective lateral end 52 of the hub portion 50 at a fold joint 66 (i.e., a hub portion-adjacent fold joint). As will be discussed in greater detail below, the wings 64 of each of the push tabs 60 are configured to bend away from a coplanar position with respect to their respective spine 62 as each push tab is being inserted in a respective one of the plurality of interlocking apertures 42 of a respective flange blank 24. Furthermore, the wings 64 of each push tab 60 are configured to lockingly engage the inwardly facing major surface 30 of a respective flange blank 24 adjacent a respective one of the plurality of interlocking apertures 42 when each push tab is lockingly received in the respective one of the plurality of interlocking apertures. As will be discussed in greater detail below, in preferred embodiments, the core blank 22 comprises a one-piece slab of material (i.e., the push tabs 60 and the hub portion 50 are portions of the same unitary slab of material). However, in other embodiments, it is contemplated that the core blank 22 could be a multi-piece assembly. For example, in certain embodiments, the push tabs 60 are hingedly attached to the lateral edges 52 of the hub portion 50. In the illustrated embodiment, each spine 62 includes an overlay portion 68 and an interlocking portion 70. The overlay portion 68 is connected to the interlocking portion 70 at a fold joint 72. As will be discussed in greater detail below, the overlay portion 68 is configured to pass through a pass through slot 40 in a flange blank and overlie a corresponding support surface 43 of a flange blank 24 when the reel assembly 20 is arranged in the reel configuration (FIG. 1). Likewise, when the reel assembly 20 is arranged in the reel configuration, the interlocking portion 70 is configured to be received in an interlocking aperture 42 of a flange blank 24.

As mentioned above, a pair of wings 64 extends outwardly from the spine 62 of each push tab 60. More specifically, each illustrated wing 64 extends outward in a direction generally parallel to the longitudinal axis of the hub portion 50 from a respective interlocking portion 70 of the spine 62. Each of the push tabs 60 includes fold joints 73 (i.e., wing-adjacent fold joints) between each of its wings 64 and its spine 62. In the illustrated embodiment the wings 64 are each foldably attached to a respective interlocking portion 70 of the spine 62 at one of the fold joints 73.

In the illustrated embodiment, each of the push tabs comprises an interlocking body, generally indicated at 74. Each interlocking body 74 has an outer end 76 and a pair of interlocking shoulders 78 opposite the outer end (e.g., at an inward end of the interlocking body). As will be discussed in greater detail below, the pair of interlocking shoulders 78 of each interlocking body is configured to lockingly engage an inwardly facing major surface of a flange blank adjacent an interlocking aperture 42 when the reel assembly 20 is configured in the reel configuration. Likewise, as will be discussed in greater detail below, the interlocking body 74 of each push tab 60 has a major surface 79 that is configured to engage the outwardly facing major surface 32 of a flange blank 24 adjacent a respective one of the interlocking apertures 42 as the push tab is being inserted therein. Each interlocking body 74 has a body width $W_B$ (FIG. 3). In the illustrated embodiment, each of the interlocking bodies 74 has the same interlocking width $W_B$. However, it is contemplated that, in other embodiments, different interlocking bodies may have different interlocking widths without departing from the scope of the invention. The body width $W_B$ of each interlocking body 74 is less than the pass through width $W_{PT}$ of a corresponding one of the pass through slots 40 and is greater than the interlocking width $W_I$ of a corresponding one of the interlocking apertures 42. As will be discussed in greater detail below, this geometry enables each push tab 60 to lockingly engage a corresponding interlocking aperture 42. In preferred embodiments, the body width $W_B$ of each interlocking body 74 is substantially constant between the pair of interlocking shoulders 78 and the outer end 76 of the interlocking body. In the illustrated embodiment, outer corners of the outer end 76 and shoulders 78 have a slight radius. Thus, the width $W_B$ of each interlocking body 74 need not be perfectly constant between its pair of interlocking shoulders 78 and its outer end 76 to be substantially constant. However, in preferred embodiments, the outer end 76 of each interlocking body 74 has a continuous flat (i.e., non-curved, non-pointed) portion extending along at least 60% of the body width $W_B$ in a direction substantially parallel to the widthwise span of the interlocking body. Likewise, in preferred embodiments, each interlocking body 74 has a blunt outer end 76. As will be discussed in greater detail below, the interlocking shoulders 78 of each push tab 60 also include a flat portion. The shoulders 78 are configured to engage an inwardly facing surface 30 of a flange blank 24 along the length of the flat portion when the respective push tab 60 is received in a respective interlocking aperture 42. The flat portion of each shoulder 78 is flush and not angled with respect to the inwardly facing surface 30 of the flange blank 24 when the push tab 60 is lockingly received in the interlocking aperture thereof.

As mentioned above, fold joints 73 connect the interlocking portion 70 of each spine 62 with each of a respective pair of wings 64. In the illustrated embodiment each of the fold joints 73 are angled outward from an outer end 76 of a respective interlocking body 74 toward a respective one of the pair of interlocking shoulders 78. As will be discussed in greater detail below, the wings 64 of each push tab 60 are configured to bend along the fold joints 73 when the push tab is inserted in an interlocking aperture 42. The angled fold joints 73 provide improved (as compared with non-angled fold joints) relief and ease of use when the push tab 64 is inserted into the interlocking aperture 42. In addition, the angled fold joints 73 improve the ease of disengagement of the push tab 64 from the interlocking aperture 42. When the push tab 64 is pulled through the interlocking aperture 42, the wings 64 also bend away from the coplanar position with respect to the spine 62, and the angled fold lines provide similar relief during disengagement. However, other fold joint orientations may also be used without departing from the scope of the invention.

The interlocking shoulders 78 are formed at respective junctions between an overlay portion 68 of a spine 62 and an interlocking body 74. Each of the illustrated overlay portions 68 narrows as it extends laterally (with respect to the hub portion 50) outward from a respective fold joint 66. Each overlay portion 68 of a spine 62 is narrower near its fold joint 72 (i.e., an interlocking body-adjacent fold joint) than its fold joint 66. In the illustrated embodiment, the overlay portion 68 has approximately the same width as the body width $W_B$ of the interlocking body 74 at the fold joint 66. The overlay portion 68 has a considerably shorter width than the body width $W_B$ of the interlocking body 74 adjacent the fold joint 72. As a result, the pass through slot 40 of a flange blank 24 is, in preferred embodiments, designed to have a pass through width $W_{PT}$ slightly wider than the body width $W_B$ of a respective push tab 60. As will be discussed in greater detail below, in some embodiments, a length of a an overlay portion 68 adjacent the fold joint 66 is received in the pass through slot 40 when a push tab 60 is locked into place with respect to a flange blank 24. Because the width of the overlay portion 68 near the fold joint 66 is approximately the same as the width of the body $W_B$, the pass through width $W_{PS}$ of the illustrated pass through slot 40 is sized to receive the overlay portion adjacent the fold joint 66 and prevent the push tab 60 from moving significantly in a direction parallel to the width of the overlay portion. For example, in some embodiments the pass through width $W_{PS}$ of the pass through slot 40 is about 100% to about 110% of the width of the overlay portion received therein. As discussed above, the length of a pass through slot 40 is, in preferred embodiments, also sized to receive the thickness of the core blank 22. The dimensions of the illustrated pass through slot 40 are, thus, sized to receive a portion of a push tab 60 adjacent its fold line 66 and thereby secure the core blank 22 from movement in two dimensions relative a flange blank 24.

Figure 4:
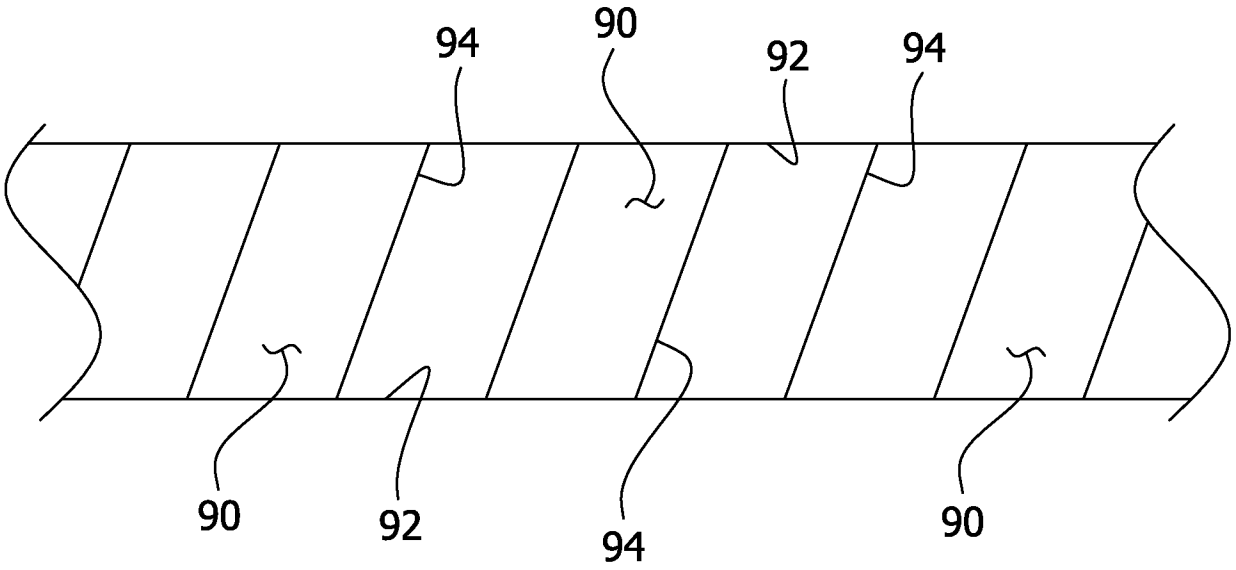
FIG. 4 is a fragmentary side view of the core blank.

As shown best in FIG. 4, the illustrated core blank 22 is made of a one-piece slab of fluted material. Preferably the flange blanks 24 are made of the same material as the core blank, though they may be made of different materials without departing from the scope of the invention. The core blank 22 has a plurality of flutes 90. Each of the flutes 90 has a longitudinal axis, and the longitudinal axes of the plurality of flutes are oriented parallel to one another. Though the illustrated core blank 220 comprises a fluted material, it is contemplated that other materials such as, for example, heavy cardstock, plastic sheeting, metal sheeting, etc. may also be used without departing from the scope of the invention. Likewise, other materials may be used for the flange blanks 24 without departing from the scope of the invention. In the illustrated embodiment, the fluted material core blank 22 is made out of plastic. The plastic material can be polyolefins, such as polypropylene (PP), polyethylene (PE), styrene polymers, such as polystyrene (PS), polyesters, such as polyethyleneterephthalate (PET), polycarbonate (PC), acrylics, such as polymethyl methacrylate (PMMA), vinyl polymers, such as polyvinyl chloride (PVC), etc. As illustrated, the core blank 22 includes a pair of spaced apart plastic sheets 92 that are held in spaced apart relationship to one another by a plurality of spaced apart plastic ribs 94. The spaced apart ribs 94 define the plurality of flutes 90. It should be understood that the fluted material may depart from strict conformity with the illustrated embodiment without departing from the scope of the invention. For example, corrugated materials may be used to define the flutes in place of the ribs 94. Likewise, one or zero external sheets of material may be used without departing from the scope of the invention.

One exemplary commercially available material that conforms to the illustrated embodiment is Plastic IntePro®, which is sold by the assignee of the present application. IntePro® of the illustrated embodiment is made of either PP or PE. Plastic materials such as Plastic IntePro® may be preferred over non-plastic materials to maximize the reusability of the core blank 22. As discussed in greater detail below, a plastic material such as Plastic IntePro® offers advantages in establishing robust fold lines in the core blank 22. Plastic IntePro® is a strong material that can withstand exposure to harsh elements. Though plastic materials are suitable for many applications, it is contemplated that other materials may have properties that serve the needs of other applications. Such other materials may be used without departing from the scope of the invention.

In a preferred embodiment, the longitudinal axes of the plurality of flutes 90 are oriented parallel to the longitudinal axis of the hub portion 50. As discussed above, the hub portion 50 includes a plurality of core joints 56 that extend between the opposite lateral ends 52 of the hub portion and that define fold lines. The core joints 56 are oriented transverse to the longitudinal axes of the plurality of flutes 90 in the core blank 22. In preferred embodiments, the core joints 56 are formed as heat scores in the core blank 22. For example, each of the core joints 56 comprises a line in the core blank 22 along which each of the pair of plastic sheets 92 is sealed (e.g., heat-sealed) against one another. Thus, the hub portion 50 of the core blank 22 comprises, in preferred embodiments, plastic fluted material that has undergone a heat scoring process in which the flutes 90 of the plastic board are heat-sealed in a crosswise direction at spaced intervals (e.g., at core joints 56) by a press roller. The heat scoring process forms spaced indentations in the core blank 22 and air pockets in the flutes 90 extending therebetween. In other embodiments, the core joints are formed by merely scoring the preferred fold lines (e.g. pre-creasing or otherwise crushing the flutes along the fold lines). Still other core joint types, including no pre-trained core joints whatsoever, may be used without departing from the scope of the invention.

One benefit realized with the heat scoring process is it advantageously reduces the flexural strength of the core blank 22 along the core joints 56. In some embodiments, it is desirable to have a very strong core blank 22 to support heavy loads (e.g., heavy lines of elongate flexible material). Fluted plastic material such as IntePro® can provide the necessary strength, particularly when the thickness of the fluted plastic material exceeds three millimeters. However, with the strength to support heavy loads comes increased rigidity that resists bending from a planar configuration (FIG. 3) toward a core configuration (FIG. 1). Using heat scoring to create the core joints 56 reduces the rigidity of the material along the fold lines without adversely affecting the strength of the material to carry heavy loads. Thus in certain embodiments, the core blank is made of a plastic fluted material exceeding three millimeters in thickness. In the illustrated embodiment, the core joints 56 are heat scored at fold lines in the hub portion 50 that do not overlap with the push tabs 60. Thus, the arrangement of core joints 56 in the illustrated embodiment trains the core blank 22 to fold along portions of the hub portion 50 other than those that are connected to the push tabs 60 when being folded toward the core configuration.

In addition to the core joints 56, the fold lines 66, 72, and 73 may also be formed using heat scoring in certain embodiments. In other embodiments, the fold lines 66, 72, and 73 may be trained into the material of the core blank 22 using other methods. In still other embodiments, the fold lines 66, 72, and 73 may not be trained into the material of the core blank 22 at all. For example the fold lines 66 and 72 may align with respective flutes 90 of plastic fluted material. In such embodiments, the aligned flutes 90 may naturally tend to collapse along the fold lines 66 and 72 as the push tab 60 is folded toward a desired position.

Figure 5:
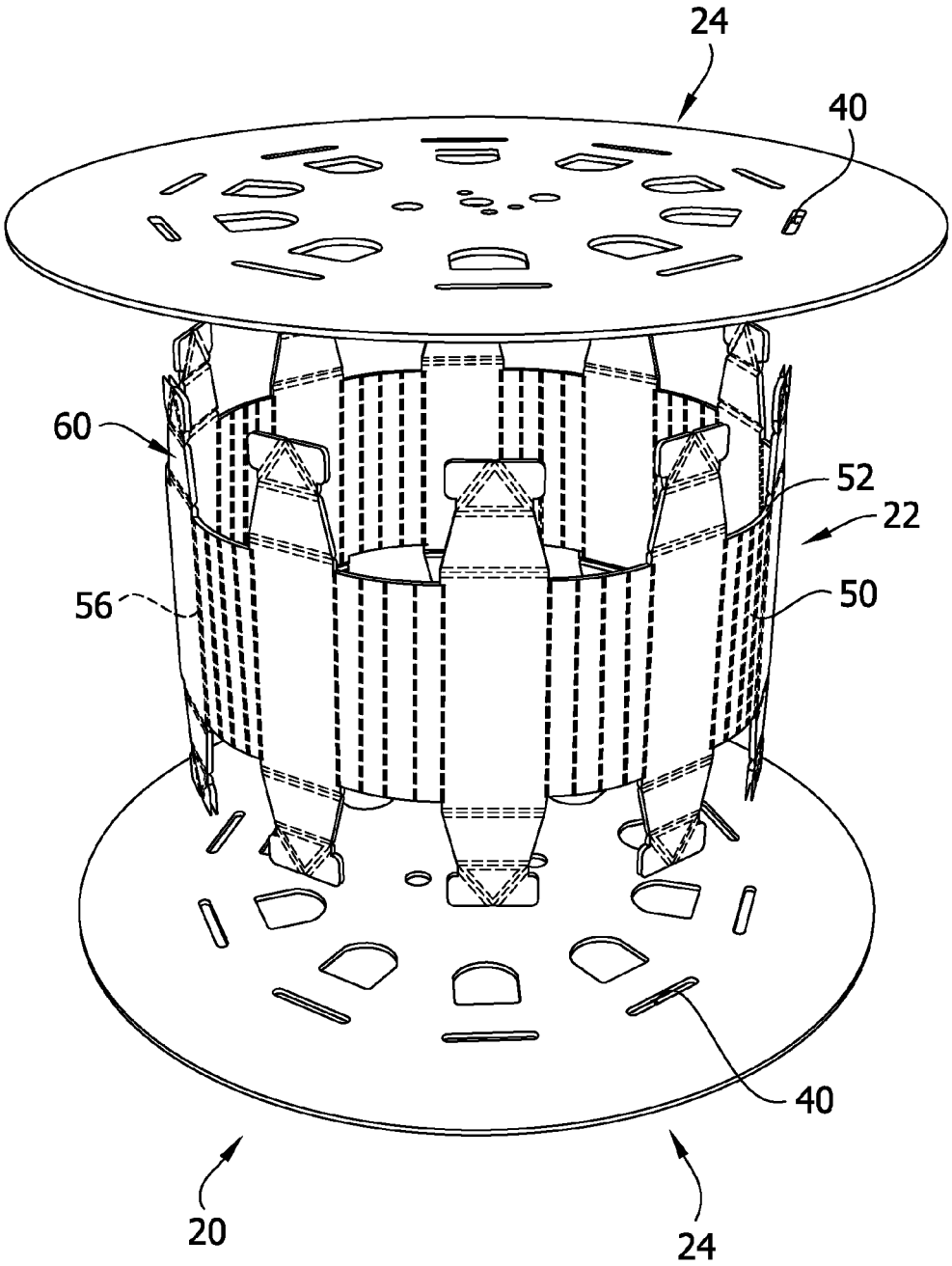
FIG. 5 is a perspective view of components of the reel assembly in an aligned configuration.
Figure 6:
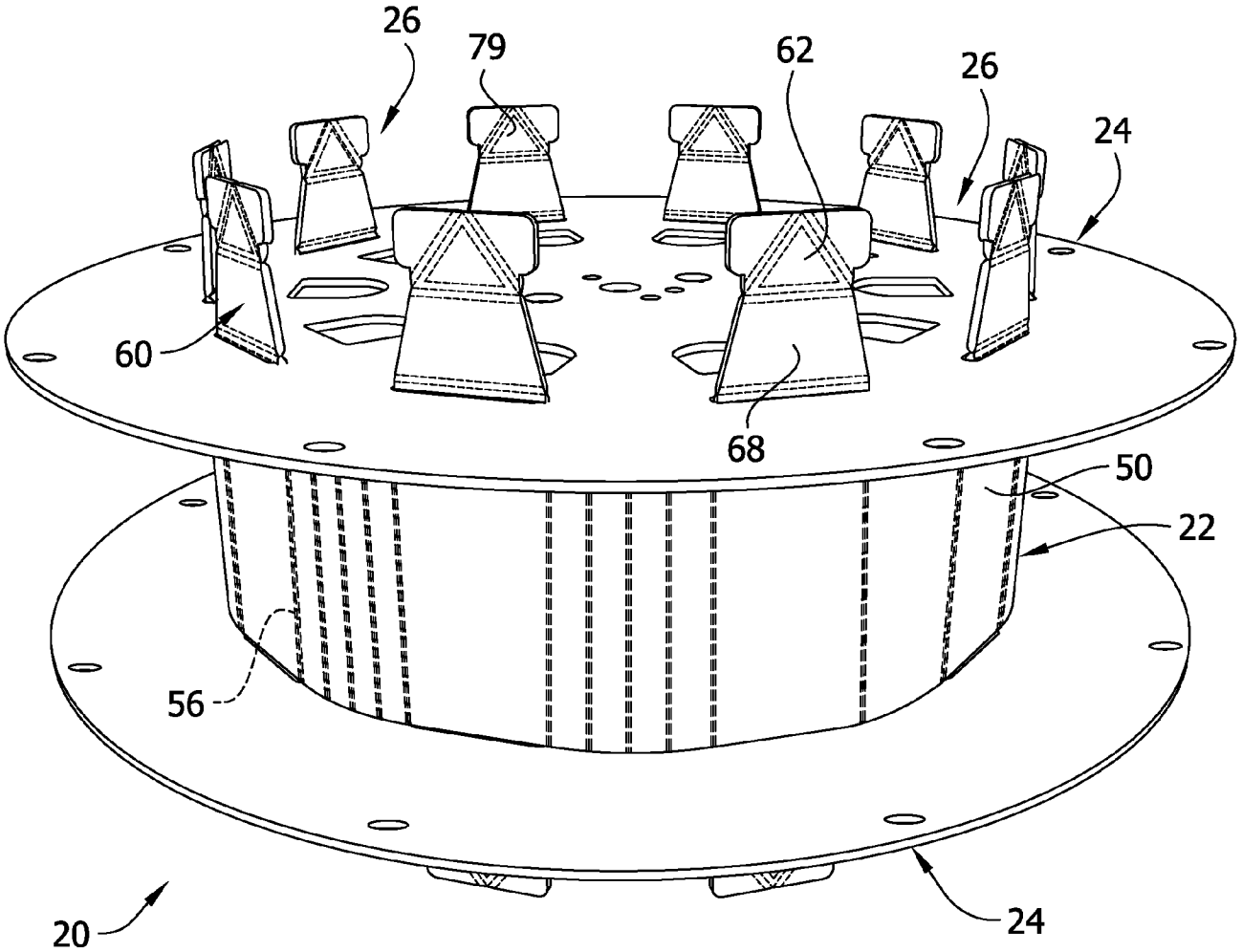
FIG. 6 is a perspective view of components of the reel assembly in another aligned configuration.

Referring to FIGS. 5 and 6, to arrange the reel assembly 20 in the reel configuration, the core blank 22 is bent toward the core configuration in which the hub portion 50 has an annular shape. Preferably, the hub portion 50 folds along the core joints 56. The longitudinal ends 54 of the hub portion 50 are interlocked with one another (or otherwise secured to one another) to secure the core blank 22 in the core configuration. However, in some embodiments, the longitudinal ends 54 need not be secured to one another. Instead, the interlocking structures 26, which secure the core blank 22 in place with respect to the flange blanks 24, are also used to secure the core blank in the core configuration. As discussed above, the core blank 22 and the flange blanks 24 are respectively designed such that, when the core blank is in the core configuration, each of the push tabs 60 extends laterally outward from a lateral end 52 of the hub portion 50 in alignment with a respective one of the pass through slots 40. As shown best in FIG. 6, to use the interlocking structures 26, each push tab 60 is inserted into one of the pass through slots 40 of a respective one of the flange blanks 24 and passed therethrough. The overlay portion 68 of the spine 62 of each of the push tabs 60 is received in the pass through slot as discussed above.

Figure 7:
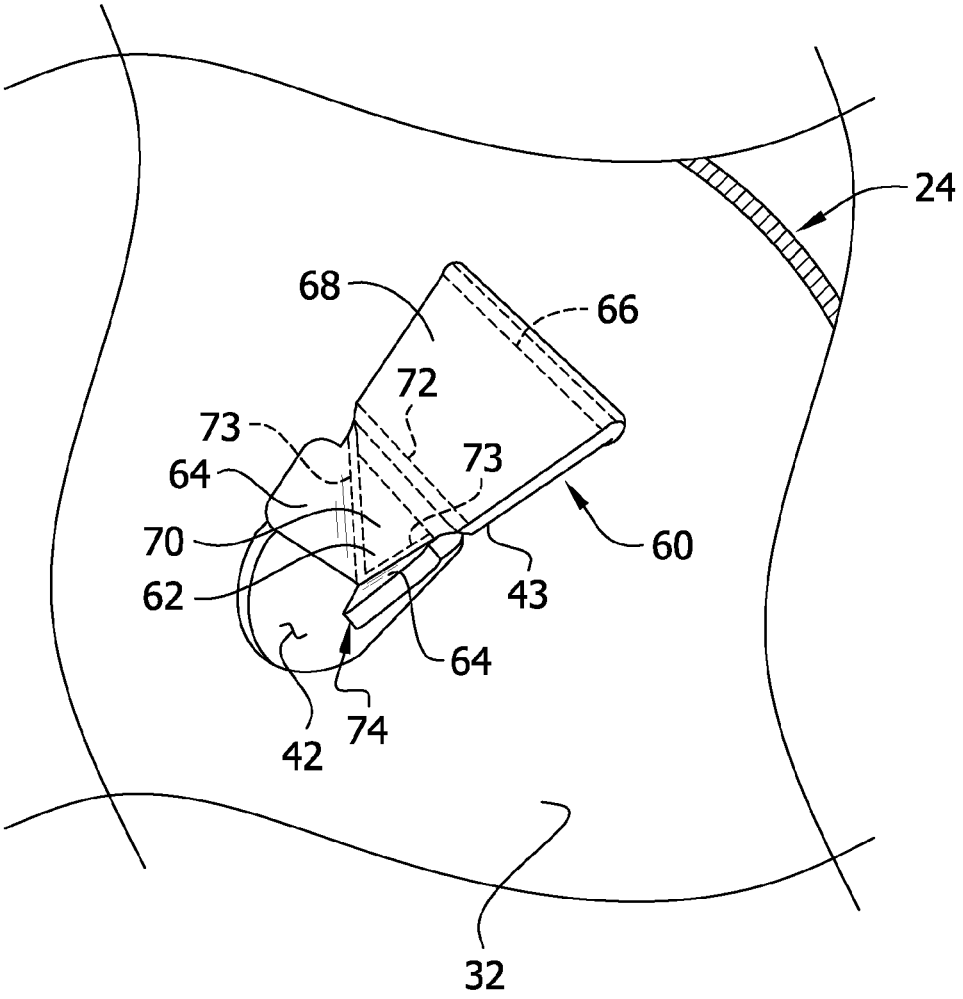
FIG. 7 is a fragmentary perspective view of a locking structure of the reel assembly in an intermediate position.

Referring to FIG. 7, once a push tab 60 of an interlocking structure 26 has been passed through a pass through slot 40, it is inserted into the interlocking aperture 42. For example, the push tab is folded inward, in the illustrated embodiment, along the fold line 66 until the overlay panel 68 overlies the respective support surface 43. The interlocking body 74 is folded inward along the fold line 72 and is inserted in the respective interlocking aperture 42. As the push tab 60 is being inserted in a respective one of the plurality of interlocking apertures 42, its wings 64 bend away from a coplanar position with respect the spine 62. Unlike dart-type locking structures, the push tab 60 of the locking structure 26 is configured to be inserted into the interlocking aperture 42 with an insertion force applied transverse to its spine axis. In the illustrated embodiment, the major surface 79 of each interlocking body 74 engages the outwardly facing major surface 32 of a respective flange blank 24 adjacent a respective one of the interlocking apertures 42 as a push tab 60 is being inserted therein. As a push tab 60 is inserted in a respective interlocking aperture 42 (and as it bends along the fold line 72), the plane of the major surface 79 of the interlocking body at the interlocking portion 70 of the spine 62 will pass through the plane of the outwardly facing major surface 32 of the respective flange blank 24. Engagement between the major surface 79 of the interlocking body 74 and the major surface 32 of the respective flange blank 24 causes the wings 64 of a push tab 60 to bend along the fold lines 73 away from the flange blank and away from the coplanar position with respect to the spine 62. As the interlocking body 74 continues to travel through the interlocking aperture 42, the wings 64 continue to bend away from the flange blank 24 along fold lines 73 until the outer edges of the wings pass through the plane of the inwardly facing major surface 30 of the flange blank.

Figure 8:
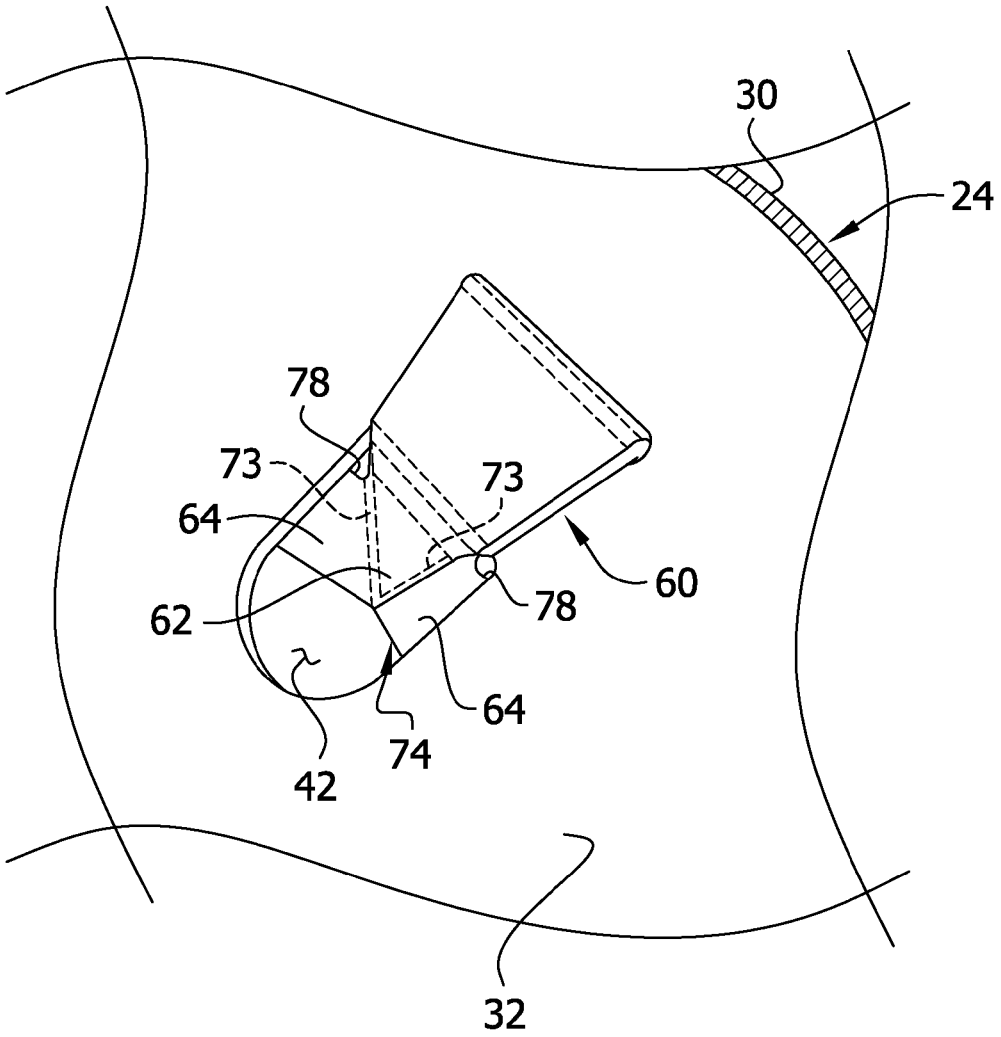
FIG. 8 is a fragmentary perspective view of the locking structure in a locked position.

In preferred embodiments, each of the push tabs 60 responds at least partially resiliently to the bending along fold lines 73 that occurs when the push tab is being inserted in the respective interlocking aperture 42. Each of the wings 64, in these preferred embodiments, is configured to resiliently return toward its respective coplanar position with respect to its spine 62 when the push tab 60 is received in the interlocking aperture 42. As shown best in FIG. 8, when the outer edges of the wings 64 pass through the plane of the inwardly facing major surface 30 of the flange blank 24, the wings 64 return (either resiliently or under a manually applied interlocking force) toward the coplanar position with respect to their spine 62. When the push tab 60 is lockingly received in the interlocking aperture 42, the wings 64 lockingly engage the inwardly facing major surface 30 of the flange blank 24 adjacent the interlocking aperture. In certain embodiments, the interlocking shoulders 78 of the interlocking body 74 lockingly engage the inwardly facing major surface 30 of the flange blank 24 adjacent the interlocking aperture 42 when the push tab is lockingly received in the interlocking aperture. When engaged in this manner, the interlocking body 74 is oriented substantially orthogonal to the flange blank. In addition or in the alternative, another major surface of the interlocking body (i.e., the major surface opposite the major surface 79) lockingly engages the inwardly facing major surface 30 of the flange blank 24 adjacent the interlocking aperture 42 when the push tab is lockingly received in the interlocking aperture.

In the illustrated embodiment, the push tab 60 is configured such that, when received in the interlocking aperture 42, the interlocking shoulders 78 engage the inwardly facing major surface 30 of the flange blank 24. As discussed above, the shoulders 78 each have a flat end that engages the inwardly facing major surface 30 of the flange blank 24 across its entire length. The only portion of the of each shoulder 78 that does not engage inwardly facing major surface 30 is the radiused outer corner portion. By comparison, a dart-type lock is angled along flange-adjacent edges (such as shoulders) so that it can be pulled back through its opening during disassembly. This angled engagement surface does not engage a flange along a substantial portion of its length. As a result, the locking capability of dart-type tabs is compromised in comparison with the locking capability of the illustrated push tab 60.

Each of the push tabs 60 is passed through a corresponding pass through slot 40 and inserted in a corresponding interlocking aperture 42 as described above to lockingly engage each of the interlocking structures 26 and secure the reel assembly 20 in the reel configuration of FIG. 1. Once the reel configuration becomes unneeded, the illustrated reel assembly 22 is suitable for disassembly and convenient storage. As discussed above, the radially inward portion 46 of each interlocking aperture 42 has a rounded end 48. The rounded aperture allows a user to insert one or more fingers in through an interlocking aperture 42 to grasp and disengage a respective one of the push tabs 60. For example, in certain embodiments, when the push tab 60 is laid flat against the outwardly facing major surface 32, the distance from the outer end 76 to the apex of the radially inward portion 48 is at least ¼ inches. As compared with straight-edged apertures, the rounded end 48 improves the ruggedness of the interlocking apertures 42. Whereas straight-edged apertures have corners that tend to tear when forces are applied as a result of reaching through the aperture to insert and remove a locking structure, the rounded end 48 of the illustrated interlocking aperture 42 can withstand repeated insertions and removals of a push tab 62. Moreover, the rounded end 48 generally conforms to the shape of a user's finger when inserting and removing the push tab. In the preferred embodiment shown, the aperture is completely unobstructed and there is no associated tongue or other obstruction extending over the opening.

Once each push tab 60 has been pushed back through its interlocking aperture 42, the flange blanks 24 are removed from the core blank 22. The push tabs 60 are passed back through and out their respective pass through slots 40. If the longitudinal ends of the hub portion 50 of the core blank 22 were secured to one another, they are unsecured. The core blank 22 is manually unfolded toward its planar configuration (FIG. 3). As discussed above, in certain embodiments, the core joints 56 permit the hub portion 50 to be returned toward the planar configuration.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A set of blanks for being repeatedly assembled into a reel configuration comprising:

a flange blank comprising an inwardly and an outwardly facing major surface, a plurality of pass through slots angularly spaced apart from one another about a transverse axis of the flange blank, and a plurality of interlocking apertures angularly aligned with the plurality of pass through slots, each of the plurality of pass through slot being spaced apart radially from a corresponding one of the plurality of interlocking apertures, each of the plurality of pass through slots having a pass through width and each of the plurality of interlocking apertures having an interlocking width, the pass through width being wider than the interlocking width;

each of the plurality of pass through slots having a pass through length and each of the plurality of interlocking apertures having an interlocking length, the interlocking length being longer than the pass through length; and a core blank comprising:

a hub portion having a longitudinal body comprising opposite lateral ends, the hub portion being configured to be folded toward a core configuration in which the hub portion has an annular shape; and a plurality of push tabs foldably attached to and extending outwardly from one of the opposite lateral ends of the hub portion, each of the plurality of push tabs being configured to pass through a respective one of the pass through slots and be lockingly received in a respective one of the interlocking apertures when the hub portion is arranged in the core configuration, each of the plurality of push tabs comprising a spine and a pair of wings extending outwardly from the spine, the wings of each of the plurality of push tabs being configured to bend away from a coplanar position with respect to their respective spine as each of the plurality of push tabs is being inserted in a respective one of the plurality of interlocking apertures, the wings of each of the plurality of push tabs being further configured to lockingly engage the inwardly facing major surface of the flange blank adjacent the respective one of the plurality of interlocking apertures when each of the plurality of push tabs is lockingly received in the respective one of the plurality of interlocking apertures.

2. The set of blanks of claim 1 wherein the push tab comprises an interlocking body having an outer end and a pair of interlocking shoulders opposite the outer end.

3. The set of blanks of claim 2 wherein the pair of interlocking shoulders are configured to lockingly engage the inwardly facing major surface of the flange blank adjacent the interlocking apertures when the push tab is lockingly received in the interlocking aperture.

4. The set of blanks of claim 3 wherein each of the pair of interlocking shoulders has a substantially flat end comprising a length and is configured to engage the inwardly facing major surface of the flange blank along the majority of the length of its substantially flat end.

5. The set of blanks of claim 1 wherein each push tab comprises an interlocking body having an outer end and a pair of interlocking shoulders opposite the outer end, and the interlocking body has a body width and the body width of the interlocking body is substantially constant between the pair of interlocking shoulders and the outer end of the interlocking body.

6. The set of blanks of claim 1 wherein each push tab comprises fold joints between each of its wings and its spine, each of the fold joints being angled outward from the outer end toward a respective one of the pair of interlocking shoulders.

7. The set of blanks of claim 1 wherein each interlocking aperture has a rounded end.

8. The set of blanks of claim 1 wherein each interlocking aperture has a rounded aperture to allow insertion of a finger through each aperture.

9. A set of blanks for being repeatedly assembled into a reel configuration comprising:

a flange blank comprising an inwardly and an outwardly facing major surface, a plurality of pass through slots angularly spaced apart from one another about a transverse axis of the flange blank, and a plurality of interlocking apertures angularly aligned with the plurality of pass through slots, each pass through slot being spaced apart radially from a corresponding one of the interlocking apertures, each of the pass through slots having a pass through width and each of the interlocking apertures having an interlocking width, the pass through width being wider than the interlocking width; and a core blank comprising:

a hub portion having a longitudinal body comprising opposite lateral ends, the hub portion being configured to be folded toward a core configuration in which the hub portion has an annular shape; and a plurality of push tabs foldably attached to and extending outwardly from one of the opposite lateral ends of the hub portion, each of the plurality of push tabs being configured to pass through a respective one of the pass through slots and be lockingly received in a respective one of the interlocking apertures when the hub portion is arranged in the core configuration, each push tab comprising a spine and a pair of wings extending outwardly from the spine, the wings of each of the push tabs being configured to bend away from a coplanar position with respect to their respective spine as each push tab is being inserted in a respective one of the plurality of interlocking apertures, the wings of each of the push tabs being further configured to lockingly engage the inwardly facing major surface of the flange blank adjacent the respective one of the plurality of interlocking apertures when each push tab is lockingly received in the respective one of the plurality of interlocking apertures;

wherein each of the plurality of interlocking apertures comprises a rounded end radially inward of the flange blank.

10. The set of blanks of claim 9 wherein one of the push tabs comprises an interlocking body having an outer end and a pair of interlocking shoulders opposite the outer end.

11. The set of blanks of claim 10 wherein the pair of interlocking shoulders are configured to lockingly engage the inwardly facing major surface of the flange blank adjacent a respective one of the plurality of interlocking apertures when said one of the push tabs is lockingly received in the interlocking aperture.

12. The set of blanks of claim 10 wherein the interlocking body has a major surface configured to engage the outwardly facing major surface of the flange blank adjacent a respective one of the plurality of interlocking apertures as said one of the push tabs is being inserted therein.

13. The set of blanks of claim 10 wherein the interlocking body has a body width that is less than the pass through width and greater than the interlocking width.

14. The set of blanks of claim 13 wherein the body width of the interlocking body is substantially constant between the pair of interlocking shoulders and the outer end of the interlocking body.

15. The set of blanks of claim 10 wherein said one of the plurality of push tabs comprises fold joints between each of its wings and its spine, each of the fold joints being angled outward from the outer end toward a respective one of the pair of interlocking shoulders.

16. The set of blanks of claim 9 wherein the core comprises a one-piece slab of fluted material, the slab comprising a plurality of flutes, each of the plurality of flutes having a longitudinal axis, the longitudinal axes of the plurality of flutes oriented parallel to one another and parallel to a longitudinal axis of the hub portion.

17. The set of blanks of claim 16 wherein the one-piece slab comprises a plurality of core joints extending between the opposite lateral ends of the hub portion and defining fold lines in the hub portion transverse to the longitudinal axes of the plurality of flutes.

18. The set of blanks of claim 17 wherein the one-piece slab comprises a pair of spaced apart sheets of plastic material held in spaced apart relationship by a plurality of spaced apart plastic ribs, the plurality of plastic ribs defining the plurality of flutes.

19. The set of blanks of claim 18 wherein each of the plurality of core joints comprises a line along which the plastic sheets of the one piece slab are sealed against one another.

20. The set of blanks of claim 9 wherein:

one of the push tabs comprises an interlocking body having an outer end, a pair of interlocking shoulders opposite the outer end, a major surface configured to engage the outwardly facing major surface of the flange blank adjacent a respective one of the plurality of interlocking apertures as said one of the push tabs is being inserted therein, a body width that is less than the pass through width and greater than the interlocking width and substantially constant between the pair of interlocking shoulders and the outer end of the interlocking body, and fold joints between each of the wings and the spine of said one of the push tabs are angled outward from the outer end toward the interlocking shoulders;

the core blank comprises a one-piece slab of fluted material, the slab comprising a plurality of flutes, each of the plurality of flutes having a longitudinal axis, the longitudinal axes of the plurality of flutes oriented parallel to one another and parallel to a longitudinal axis of the hub portion; and each pass through slot is spaced apart radially outwardly from a corresponding one of the interlocking apertures.

21. A core blank for being repeatedly secured in a core configuration in a reel assembly, the core blank comprising:

a one-piece slab of fluted material, the slab comprising a pair of spaced apart sheets of plastic material held in spaced apart relationship by a plurality of spaced apart plastic ribs, the plurality of plastic ribs defining a plurality of flutes, each of the plurality of flutes having a longitudinal axis, the longitudinal axes of the plurality of flutes oriented parallel to one another; and a hub portion having a longitudinal body comprising opposite lateral ends, the hub portion comprising a plurality of core joints extending between the opposite lateral ends of the hub portion and defining fold lines in the hub portion transverse to the longitudinal axes of the plurality of flutes, wherein the longitudinal axes of the plurality of flutes are parallel to a longitudinal axis of the hub, each of the plurality of core joints comprising a line along which the plastic sheets of the one-piece slab are sealed against one another, the hub portion being configured to be folded along the fold lines of the core joints toward a core configuration in which the longitudinal body has an annular shape.

* * * * *